US006802139B2

(12) United States Patent
Pitts et al.

(10) Patent No.: US 6,802,139 B2
(45) Date of Patent: Oct. 12, 2004

(54) SLIP-ON MOCCASIN-STYLE GOLFING SHOE

(75) Inventors: Karen A. Pitts, Milton, MA (US); James Walter, Swampscott, MA (US); Bobby Joe Peace, Portsmouth, NH (US); James Weidman, Dover, NH (US)

(73) Assignee: Columbia Insurance Company, Omaha, NE (US)

( * ) Notice: Subject to any disclaimer, the term of this patent is extended or adjusted under 35 U.S.C. 154(b) by 23 days.

(21) Appl. No.: 10/121,277

(22) Filed: Apr. 12, 2002

(65) Prior Publication Data

US 2002/0178618 A1 Dec. 5, 2002

Related U.S. Application Data

(60) Provisional application No. 60/283,895, filed on Apr. 13, 2001.

(51) Int. Cl.[7] ..... A43B 11/00

(52) U.S. Cl. ..... 36/51; 36/54; 36/138; 36/127

(58) Field of Search ..... 36/127, 51, 54, 36/58.5, 92, 80

(56) References Cited

U.S. PATENT DOCUMENTS

| | | | | |
|---|---|---|---|---|
| 107,962 A | | 1/1870 | Lanz | |
| 118,137 A | | 12/1871 | Pick | |
| 249,410 A | * | 11/1881 | Siegenthaler | 36/51 |
| 312,675 A | * | 2/1885 | Turner | 36/51 |
| 335,947 A | | 6/1886 | Shelly | D2/271 |
| 336,973 A | | 7/1886 | Fritcher | D2/311 |
| 424,795 A | | 5/1890 | Matis | D2/969 |
| 428,691 A | | 8/1890 | Matis | D2/969 |
| 528,784 A | * | 11/1894 | Marshall | 36/51 |
| 912,579 A | * | 2/1909 | Krech et al. | 36/58.5 |
| 913,012 A | * | 2/1909 | Jackson | 36/51 |
| 1,247,435 A | * | 11/1917 | McHannan | 36/51 |
| 1,862,047 A | * | 6/1932 | Boulet et al. | 24/437 |
| 2,080,959 A | * | 5/1937 | Cobb | 36/68 |
| 2,097,810 A | * | 11/1937 | Dawes | 36/51 |
| 2,379,000 A | * | 6/1945 | Gould | 36/173 |
| 3,040,454 A | * | 6/1962 | Topper et al. | 36/51 |
| 3,050,878 A | * | 8/1962 | Goeckner et al. | 36/58.5 |
| 3,613,274 A | * | 10/1971 | Willey | 36/68 |

(List continued on next page.)

FOREIGN PATENT DOCUMENTS

DE 3415960 * 11/1984

*Primary Examiner*—M. D. Patterson
(74) *Attorney, Agent, or Firm*—St. Onge Steward Johnston & Reens LLC

(57) ABSTRACT

A slip-on, moccasin-style golfing shoe has a shoe sole having a bottom surface with contours for gripping a golfing surface during striking of a golf ball; an upper, with the shoe sole, defining a volume for receiving a wearer's foot and defining an opening for insertion of a wearer's foot into the volume, the upper including resilient closure assembly fixedly extending across a forward portion of the opening; and, disposed within the volume, a heel cup of extended length, reduced width, and increased stiffness, for resisting lateral movement of a heel region of the wearer's foot during striking of a golf ball. The shoe sole defines a depressed footbed surface for a lower center of gravity and increased stability during golfing play. The closure assembly, in a first, wearing condition, resiliently engages across the wearer's foot to provide a secure fit during golfing play, and, in a second, donning or doffing condition, resiliently expands to facilitate passage of the wearer's foot into and out of the volume. The closure element includes a tongue having side edges attached to the upper, and the tongue has a upper end portion defining a surface positioned to resiliently engage upon an ankle surface above the wearer's foot.

16 Claims, 4 Drawing Sheets

U.S. PATENT DOCUMENTS 3,952,430 A * 4/1976 Pankin et al. ..... 36/51
4,270,285 A * 6/1981 Antonious ..... 36/50.1
4,451,995 A * 6/1984 Antonious ..... 36/51
4,608,769 A 9/1986 Sturlaugson ..... 36/68
4,811,497 A 3/1989 Ciudad ..... 36/51
5,230,171 A * 7/1993 Cardaropoli ..... 36/50.1
5,416,987 A * 5/1995 Bemis et al. ..... 36/50.1
5,430,958 A * 7/1995 Kiyosawa ..... 36/83
5,555,650 A 9/1996 Longbottom et al. ..... 36/114
5,765,296 A * 6/1998 Ludemann et al. ..... 36/51

* cited by examiner

SLIP-ON MOCCASIN-STYLE GOLFING SHOE

This application claims benefit from U.S. Provisional Application No. 60/283,895, filed Apr. 13, 2001.

TECHNICAL FIELD

This invention relates to footwear, and more particularly to golfing footwear.

BACKGROUND

Golf shoes have typically taken the form of laced shoes with spike soles. Both the spikes and lacing reflect the importance of obtaining sure footing and grip upon the golfing surface during play. In particular, the spikes are considered necessary for the shoe to grip the golfing surface during each shot, and the lacing steadies the foot within the shoe. More recently, laces have been replaced or supplemented by straps with VELCRO®-type hook-and-loop releasable fasteners.

SUMMARY

In the broadest aspects of the invention, a golfing shoe has a slip-on moccasin-style construction, including a resilient closure without laces or releasable strap.

According to the invention, a slip-on, moccasin-style golfing shoe comprises a shoe sole having a bottom surface with contours for gripping a golfing surface during striking of a golf ball, the shoe sole defining a depressed footbed surface for a lower center of gravity and increased stability during golfing play; an upper, with the shoe sole, defining a volume for receiving a wearer's foot and defining an opening for insertion of a wearer's foot into the volume, the upper comprising a resilient closure assembly fixedly extending across a forward portion of the opening, the closure assembly, in a first, wearing condition, resiliently engaging across the wearer's foot to provide a secure fit during golfing play, the closure assembly, in a second, donning or doffing condition, resiliently expanding to facilitate passage of the wearer's foot into and out of the volume, and the closure element comprising a tongue having side edges attached to the upper and the tongue having a upper end portion defining a surface positioned to resiliently engage upon an ankle surface above the wearer's foot; and, disposed within the volume, a heel cup of extended length, reduced width, and increased stiffness, for resisting lateral movement of a heel region of the wearer's foot during striking of a golf ball.

Preferred embodiments of the invention may include one or more of the following additional features. The upper further comprises a pull tab at a rear region and/or at a forward region of the opening, to facilitate donning of the shoe upon the wearer's foot. The tongue further comprises a collar extending radially from the upper end portion of the tongue, the collar with the upper end portion of the tongue defining a surface positioned to resiliently engage upon and radially about the ankle surface above the wearer's foot. The tongue and collar are formed of expanded polymeric material. The closure assembly further comprises a webbing of elastic material mounted to extend laterally, across the forward region of the opening. Alternatively, the closure assembly further comprises a plurality of resilient straps mounted to extend laterally, across the forward region of the opening.

Objectives of the invention include providing a golfing shoe offering secure footing during play, but with more comfortable fit achieved in a slip-on moccasin-style golfing shoe construction having a fixed, yet resilient closure of the front shoe opening.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
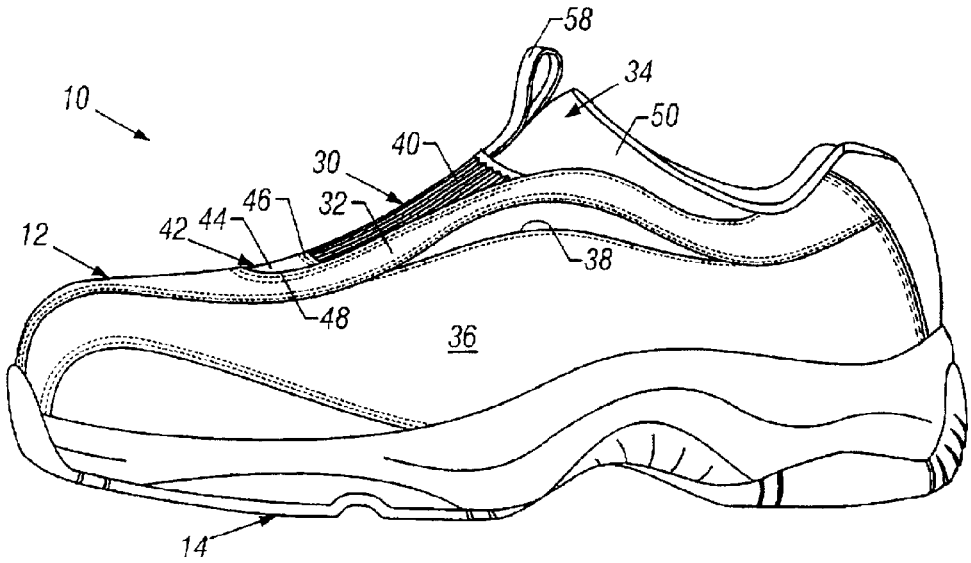
FIG. 1 is a side view of a first embodiment of a slip-on moccasin-type golfing shoe of the invention.
Figure 2:
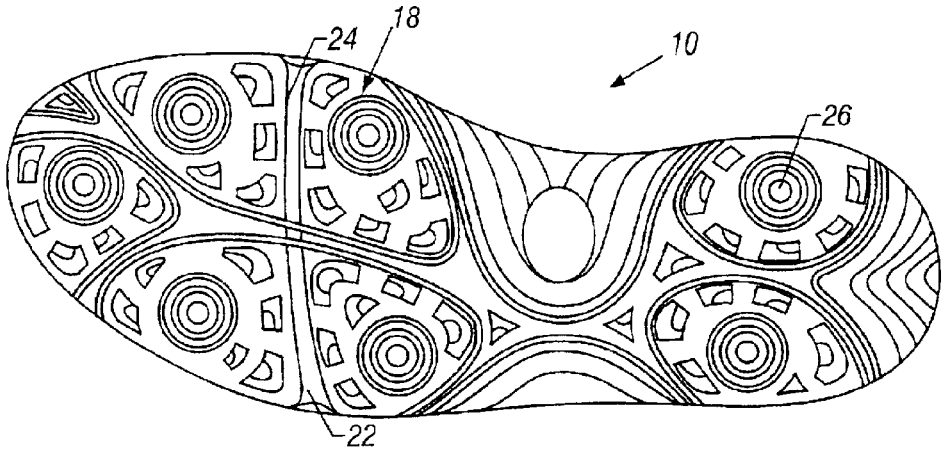
FIG. 2 is a bottom view of the outsole of the slip-on moccasin-type golfing shoe of FIG. 1.
Figure 3:
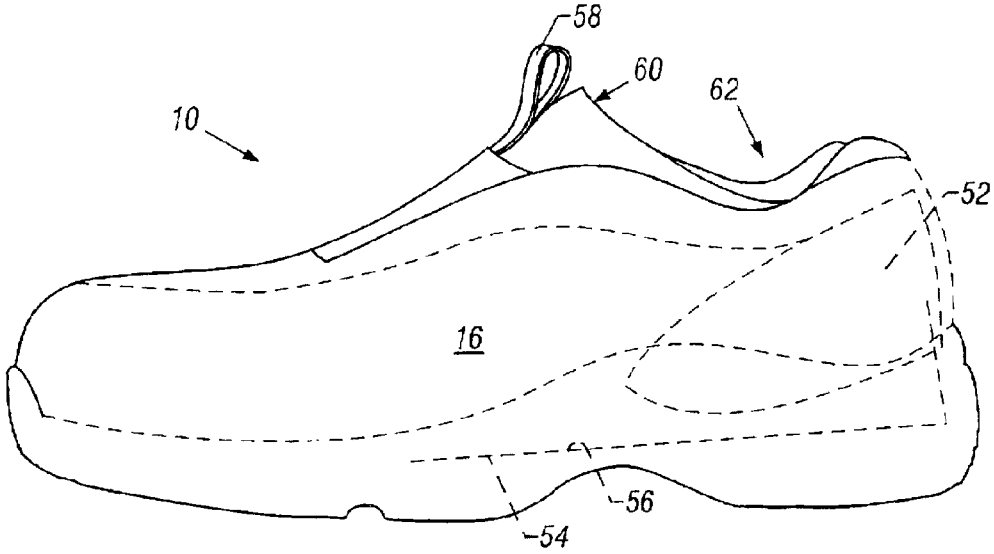
FIG. 3 is a somewhat diagrammatic side section view of the slip-on moccasin-type golfing shoe of FIG. 1.

Referring to FIGS. 1, 2, and 3, in a first embodiment, a slip-on moccasin-style golfing shoe 10 of the invention has an upper assembly 12 and an outsole assembly 14, which together define a shoe volume 16. Referring to FIG. 2, the outsole body 18 has a bottom surface 20 defining a pattern of grooves 22 and edges 24 for gripping upon a golfing surface. The outsole bottom surface 20 further defines a pattern of apertures 26 for receiving replaceable golfing spikes or cleats, e.g. DEXTER® FAST TWIST™ REACTIVE 2 golfing spikes, as available from Dexter Shoe Company, of Dexter, Me. (not shown), for gripping the surface during golfing play. The shoe upper assembly 12 defines an open region 30 at the front of the shoe, between opposite eyestay region elements 32 (only one is shown), as necessary to facilitate placing the shoe upon the foot. However, in place of the releasable closure devices such as laces and releasable straps typical in traditional golfing shoes, the slip-on moccasin-style golfing shoes 10 of the invention has a tongue and collar 34 of elastic foam material, e.g., NEOPRENE®, fixedly mounted to extend along and generally across the entire open region 30, between opposite eyestay region elements 32 and at least about the front surface of a wearer's leg at the ankle. The tongue and collar 34 also extends about the top of the wearer's foot, to fixed attachment to the shoe upper side panels 36, e.g., at regions along edges 38. Additional resilient support is provided at the open region 30 by elastic gore webbing 40 extending across the open region 30, between the eyestay region elements 32, and, at the forward region 42 of the open region 30, towards the toe, still further resilient support is provided by a panel 44 of resilient material, e.g., leather, with a binding 46, e.g. formed of LYCRA® elastomeric material, available from E. I. du Pont de Nemours and Company, of Wilmington, Del. The panel 44 is also fixedly secured along its periphery 48 to the eyestay region elements 32.

In addition, in order to provide the enhanced foot support found desirable in footwear used during golf, the upper assembly 12 of the golfing shoe 10 is constructed with the collar portion 50 of the tongue and collar 34 positioned to ride relatively higher about the wearer's ankle, and a stiffer, relatively longer heel cup or counter 52. The heel counter 52 is molded tightly to the shape of a last specially designed to allow a more secure fit across the top of the foot, due, e.g., to the tongue and collar 34, while a more narrow shape to the heel cup 52 holds the heel of a wearer tightly in place, resisting slippage and rolling. The slip-on moccasin-style golfing shoe 10 of the invention also has a relatively lower footbed 54, which is achieved by placing the insole surface 56 down within the outsole body 18 for lower center of gravity and therefore better balance. A pull-tab 58 is provided at the front 60 of the foot opening 62, to facilitate donning of the shoe.

Figure 4:
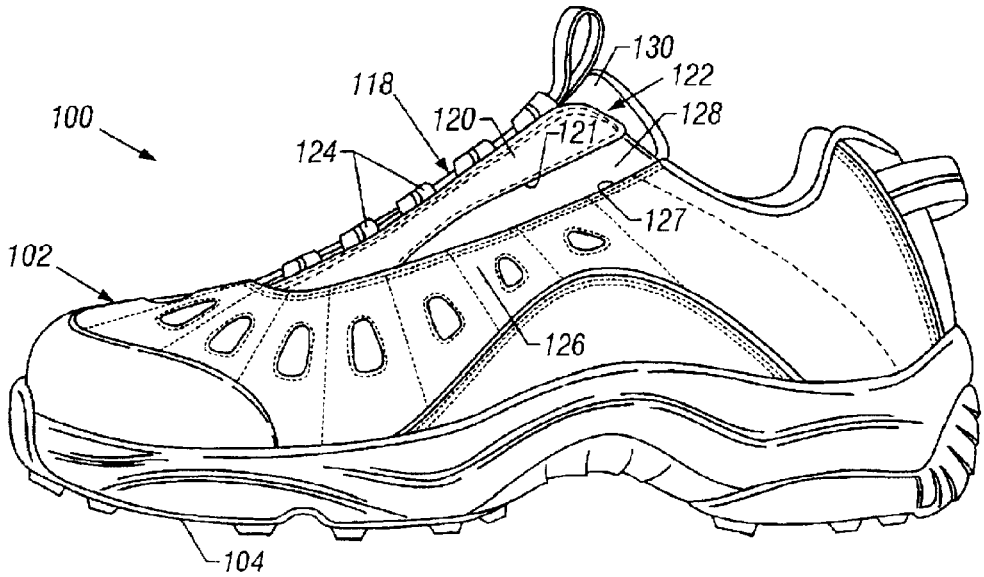
FIG. 4 is a side view of a second embodiment of a slip-on moccasin-type golfing shoe of the invention.
Figure 5:
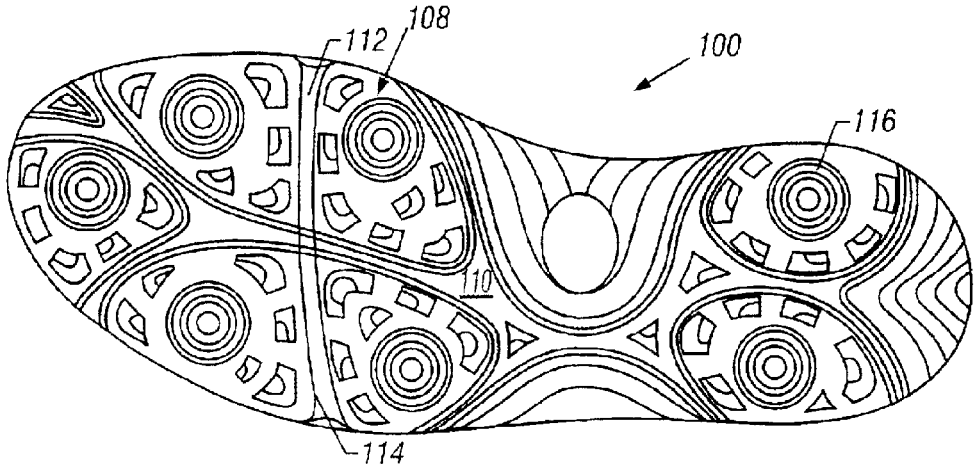
FIG. 5 is a bottom view of the outsole of the slip-on moccasin-type golfing shoe of FIG. 4.
Figure 6:
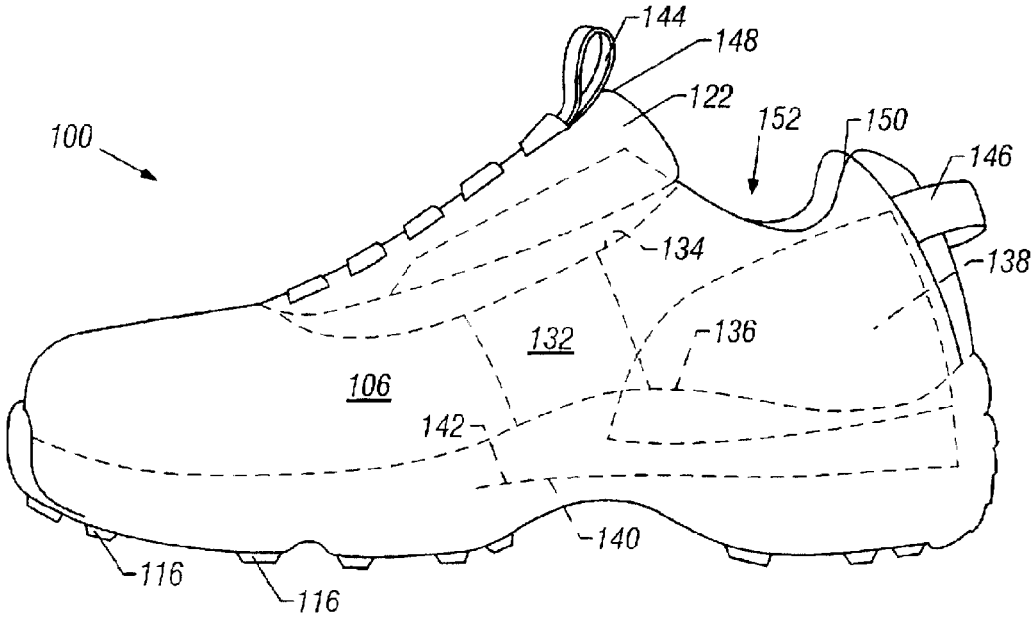
FIG. 6 is a somewhat diagrammatic side section view of the slip-on moccasin-type golfing shoe of FIG. 4.

Referring to FIGS. 4–6, in second embodiment, a slip-on moccasin-style golfing shoe 100 of the invention has an upper assembly 102 and an outsole assembly 104, which together define a shoe volume 106. Referring to FIG. 5, the outsole body 108 has a bottom surface 110 defining a pattern of grooves 112 and edges 114 for gripping upon a golfing surface. The outsole bottom surface 110 further defines a pattern of apertures (not shown) for receiving replaceable golfing spikes or cleats 116 for gripping the surface during golfing play. The shoe upper assembly 102 defines an open region 118 at the front of the shoe, towards the toe, between opposite eyestay region elements 120 (only one is shown), as necessary to facilitate placing the shoe upon the foot, and a tongue 122 of fabric, e.g., nylon, mounted to extend along and across the shoe front open region 118, between the opposite eyestay region elements 120. However, in place of the releasable closure devices such as laces or releasable straps typical in traditional golfing shoes, in the second embodiment of the slip-on moccasin-style golfing shoe of the invention, there is provided a set of parallel webs 124 fixedly attached at opposite ends to eyestay region elements 120 and extending across the tongue 122. The respective eyestay region elements 120 are resiliently secured to shoe side panels 126 by stretch elements 128, e.g., elastic gore strips, joined to the eyestay region elements 120 and shoe side panels 126 along edges 121, 127, respectively. The upper end portion 130 of tongue 122 extends over the upper surface of the wearer's foot, and within the volume 106 of the shoe 100, straps 132 of resilient material, e.g., elastic nylon, are secured at opposite ends between opposite side edges 134 of the tongue 122 and lining edges 136 of the side panels 126.

In addition, as described above, in order to provide enhanced foot support found desirable in footwear used during golf, the golfing shoe upper assembly 102 is constructed a stiffer, relatively longer heel cup or counter 138. The slip-on moccasin-style golfing shoe 100 of the invention also has a relatively lower footbed 140, which is achieved by placing the insole surface 142 down within the outsole body 106 for lower center of gravity. Pull-tabs 144, 146 placed at the front 148 and rear 150, respectively, of the foot opening 152, to facilitate donning of the shoe 100.

Figure 7:
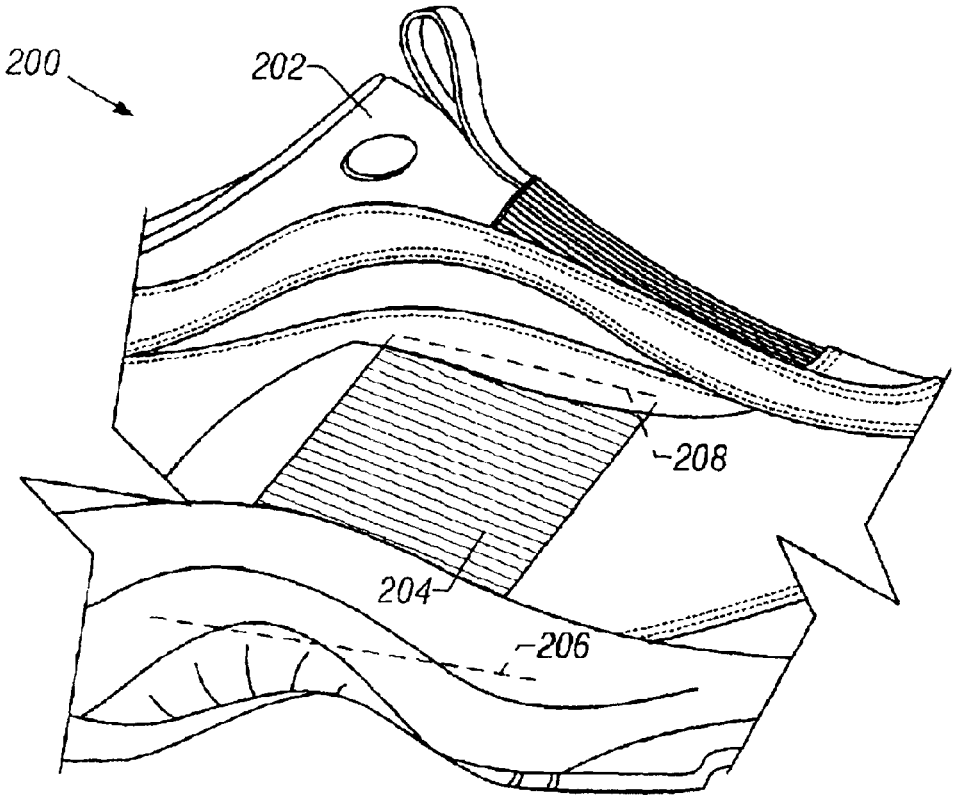
FIG. 7 is a somewhat diagrammatic partial side view of another embodiment of a slip-on moccasin-type golfing shoe of the invention.

A number of embodiments of the invention have been described. Nevertheless, it will be understood that various modifications may be made without departing from the spirit and scope of the invention. For example, referring to FIG. 7, in another embodiment of a slip-on, moccasin-style golfing shoe 200 of the invention, the tongue 202 may be resiliently secured by a strap 204 of resilient material, e.g. elastic nylon, wrapped under the insole board 206 and attached at each end 208 to opposite side edges of the tongue 202. Accordingly, other embodiments are within the scope of the following claims.

What is claimed is:

1. A slip-on, moccasin-style shoe comprising:

an outsole;

an upper assembly attached to said outsole, said upper assembly having two eyestay portions, said upper and said outsole together at least partially defining a volume for receiving a wearer's foot and at least partially defining an opening for insertion of a wearer's foot into the volume;

wherein said upper assembly defines a slit between the eyestay portions, the slit extending from the opening toward a front of the shoe;

a tongue formed from elastic material attached to and extending between the eyestay portions in the area of the slit for resiliently securing the wearer's foot within the shoe; and an additional resilient support formed from elastic material attached to and extending between the eyestay portions in the area of the slit and adjacent said tongue for further resiliently securing the wearer's foot within the shoe.

2. The shoe of claim 1 wherein the slit terminates in a closed forward region, and further comprising a panel of resilient material attached to and extending between the eyestay portions in the closed forward area of the slit and adjacent said tongue and said additional resilient support for further resiliently securing the wearer's foot within the shoe.

3. The shoe of claim 1 further comprising a pull tab at a rear region of the opening to facilitate donning of the shoe upon the wearer's foot.

4. The shoe of claim 1 further comprising a pull tab at a forward region of the opening to facilitate donning of the shoe upon the wearers foot.

5. The shoe of claim 1 wherein said tongue is formed from expanded polymeric material.

6. A slip-on, moccasin-style shoe comprising:

an outsole;

an upper assembly attached to said outsole, said upper assembly having two eyestay portions and two side portions, said upper and said outsole together at least partially defining a volume for receiving a wearers foot and at least partially defining an opening for insertion of a wearers foot into the volume;

wherein said upper assembly defines a top slit between the eyestay portions, the top slit extending from the opening toward a front of the shoe, and at least one side slit between one of the eyestay portions and an adjacent one of the side portions;

first elastic material attached to and extending between the eyestay portions in the area of the top slit for resiliently securing the wearers foot within the shoe; and second elastic material attached to and extending between the one of the eyestay portions and the adjacent one of the side portions in the area of the side slit.

7. The shoe of claim 6 wherein said first elastic material comprises a plurality of resilient straps mounted to extend laterally across the top slit.

8. The shoe of claim 6 wherein the at least one side slit comprises two side slits, each of the two side slits defined by said upper assembly between one of the eyestay portions and an adjacent one of the side portions.

9. The shoe of claim 6 further comprising a tongue mounted to said upper assembly and extending along and across the top slit.

10. The shoe of claim 6 further comprising a pull tab at a rear region of the opening to facilitate donning of the shoe upon the wearer's foot.

11. The shoe of claim 6 further comprising a pull tab at a forward region of the opening to facilitate donning of the shoe upon the wearer's foot.

12. A slip-on, moccasin-style shoe comprising:

an outsole;

an insole board disposed within said outsole;

an upper assembly attached to said outsole, said upper assembly having two eyestay portions, said upper and said outsole together at least partially defining a volume for receiving a wearer's foot and at least partially defining an opening for insertion of a wearer's foot into the volume;

wherein said upper assembly defines a slit between the eyestay portions, the slit extending from the opening toward a front of the shoe;

a tongue formed from elastic material extending between the eyestay portions in the area of the slit for resiliently securing the wearer's foot within the shoe;

a strap of resilient material wrapped under said insole board and attached at each end thereof to an opposite side edge of said tongue; and an additional resilient support formed from elastic material attached to and extending between the eyestay portions in the area of the slit and adjacent said tongue for further resiliently securing the wearer's foot within the shoe.

13. The shoe of claim 12 wherein the slit terminates in a closed forward region, and further comprising a panel of resilient material attached to and extending between the eyestay portions in the closed forward area of the slit and adjacent said tongue and said additional resilient support for further resiliently securing the wearer's foot within the shoe.

14. The shoe of claim 12 further comprising a pull tab at a rear region of the opening to facilitate donning of the shoe upon the wearer's foot.

15. The shoe of claim 12 further comprising a pull tab at a forward region of the opening to facilitate donning of the shoe upon the wearer's foot.

16. The shoe of claim 12 wherein said tongue is formed from expanded polymeric material.

* * * * *